United States Patent [19]

Badon et al.

[11] Patent Number: 4,562,319

[45] Date of Patent: Dec. 31, 1985

[54] METAL-CLAD PUFFER-TYPE CIRCUIT-BREAKER HAVING CLOSING RESISTORS

[75] Inventors: Aimé Badon, St. Ismier; Jean-Yves Berthonnier, St. Martin-le-Vinoux; Claude Mounier, Grenoble, all of France

[73] Assignee: Merlin Gerin, France

[21] Appl. No.: 156,477

[22] Filed: Jun. 4, 1980

[30] Foreign Application Priority Data

Jun. 6, 1979 [FR] France ..... 79 14666

[51] Int. Cl.[4] ..... H01H 33/16; H01H 33/89; H01H 9/42

[52] U.S. Cl. ..... 200/144 AP; 200/148 A; 200/145; 200/148 D

[58] Field of Search ..... 200/144 AP, 145, 148 D

[56] References Cited

U.S. PATENT DOCUMENTS

| | | | |
|---|---|---|---|
| 2,336,316 | 12/1943 | Thommen | 200/145 |
| 2,840,670 | 6/1958 | Leeds et al. | 200/145 |
| 2,999,143 | 9/1961 | Baker et al. | 200/148 D |
| 3,378,661 | 4/1968 | Ramrath . | |
| 3,590,186 | 6/1971 | Brunner et al. . | |
| 3,895,202 | 7/1975 | Okerman et al. | 200/144 AP |

FOREIGN PATENT DOCUMENTS

| | | | |
|---|---|---|---|
| 2357209 | 2/1975 | Fed. Rep. of Germany . | |
| 1434407 | 2/1966 | France . | |
| 1443844 | 5/1966 | France . | |
| 2235470 | 1/1975 | France . | |
| 466861 | 2/1969 | Switzerland | 200/144 AP |

*Primary Examiner*—Robert S. Macon
*Attorney, Agent, or Firm*—Parkhurst & Oliff

[57] ABSTRACT

A multibreak puffer-type circuit-breaker having a cylindrical enclosure filled with pressurized gas, such as SF6 and including a plurality of staggered arc-extinguishing units electrically connected in series. Closing resistors associated with each unit extend cross-wise to the longitudinal direction of the enclosure and are arranged in spaces between the main and auxiliary contacts. The resistors are operated by an auxiliary control rod so as to be inserted during a closing operation prior to engagement of the main contacts.

7 Claims, 2 Drawing Figures

METAL-CLAD PUFFER-TYPE CIRCUIT-BREAKER HAVING CLOSING RESISTORS

This invention relates to a multi-break arc-extinguishing pole unit for a high-voltage metal-clad puffer-type circuit breaker comprising:

a grounded metallic enclosure of substantially cylindrical shape, filled with a pressurized insulating gas of high dielectric strength, such as sulfur hexafluoride, a plurality of electrically series-connected arc-extinguishing units spaced apart in said enclosure in the longitudinal direction thereof, each unit having a pair of elongated separable stationary and movable main contacts extending parallelly to said longitudinal direction, and a pair of auxiliary contacts electrically connected in series with a resistor so as to form a shunting resistance circuit connected in parallel with the associated pair of main contacts, a main control rod of insulating material which connects the aligned movable main contacts to an operating mechanism an auxiliary control rod of insulating material which connects the aligned movable auxiliary contacts to said operating mechanism.

Such a known circuit breaker is described in the U.S. Pat. No. 3,895,202 and comprises resistors inserted into the circuit by the auxiliary contacts during a closing operation prior to engagement of the main contacts in order to limit the switching overvoltages upon closing of the pole unit. The elongated resistors extend parallel to the longitudinal direction of the enclosure and are inserted between the successive partition plates of conductive material which support the arc-extinguishing units. This longitudinal arrangement of the resistors does not allow the pitch of the successive plates to be maintained and needs particular support means and a greater enclosure that increase the manufacture cost of the circuit-breaker.

Further adjunction of resistors is not possible after assembling of this usual circuit-breaker.

The object of this invention is to provide an improved metal-clad circuit-breaker having closing resistors of reduced space which extend cross-wise to the longitudinal direction of the enclosure.

These and other objects and advantages will become apparent upon reading of the following description of an embodiment of the invention given by way of example only and represented in the annexed drawings, in which.

Figure 1:
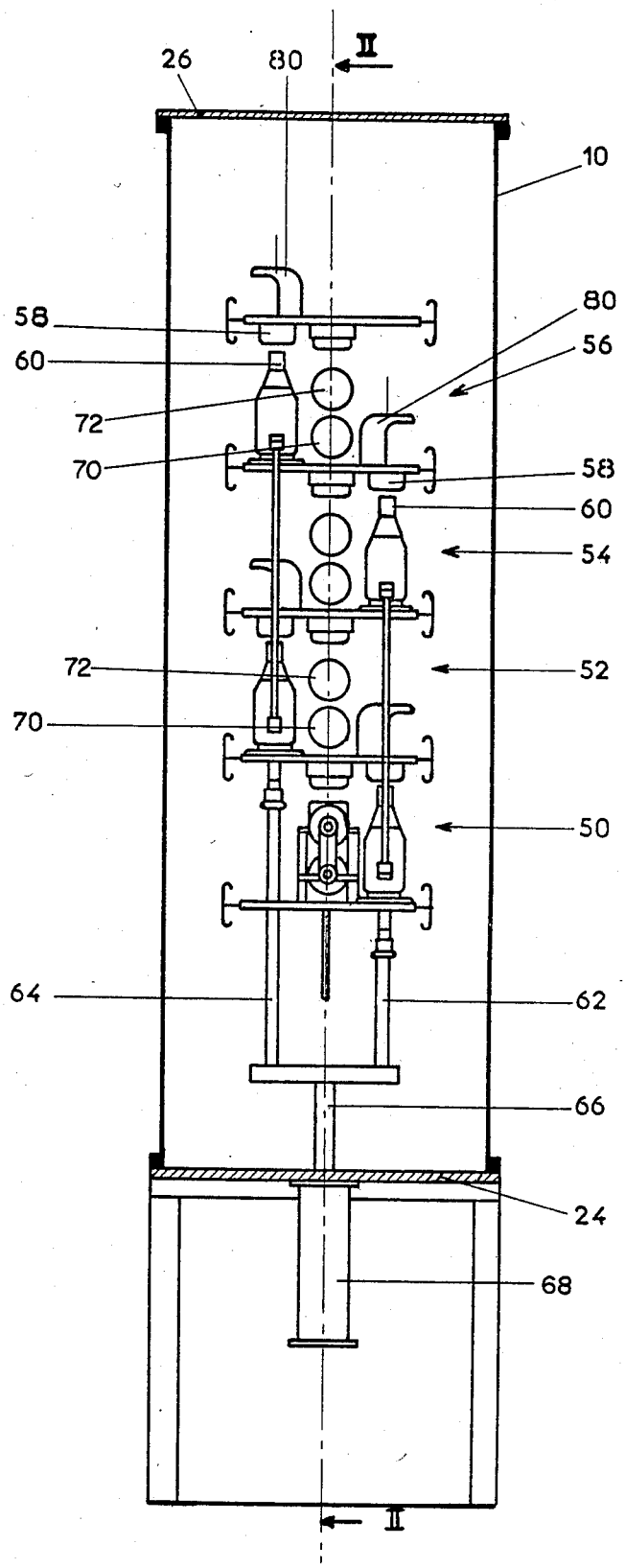
FIG. 1 is a schematic front elevational view of a pole of a circuit-breaker according to the invention.
Figure 2:
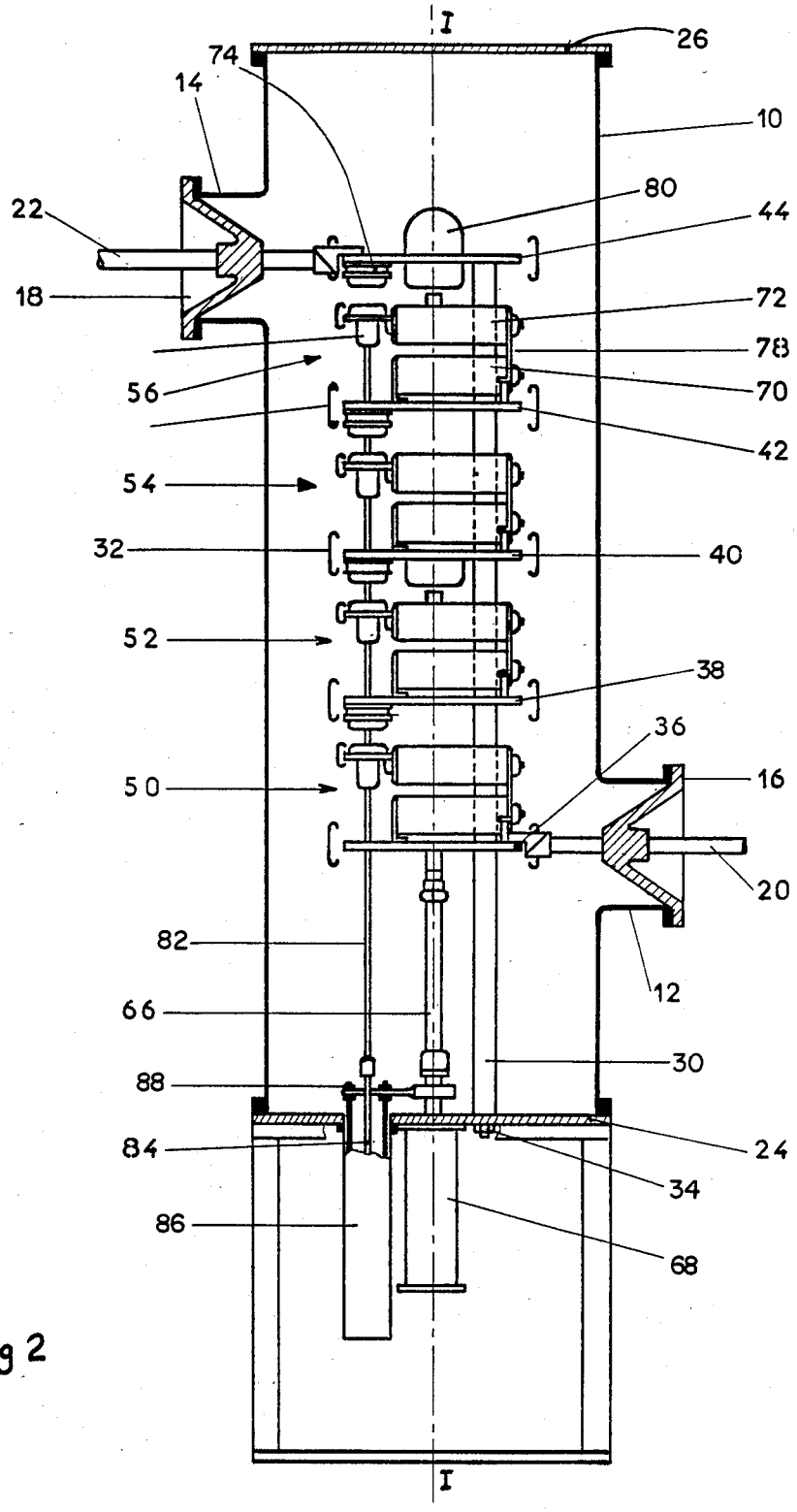
FIG. 2 is a cross sectional side view taken along line II—II of FIG. 1.

In the FIGS. 1 and 2, a cylindrical pressure enclosure 10 comprises a pair of lateral projections 12, 14, which are vertically spaced apart and support through cone-shaped insulators 16, 18 axial conductors 20, 22 respectively, constituting input and output connections or bushings of a circuit-breaker located inside said enclosure 10. A top cover 26 and a bottom cover 24 are removably bolted to the end portions of the enclosure 10 in a gastight manner and the enclosure is filled with a pressurized insulating gas of high dielectric strength, such as sulfur hexafluoride of 3, 5 bars. The cylindrical enclosure 10 shown in the figures is arranged vertically but it is of course also possible to dispose the enclosure horizontally on a pedestal, the whole being on earth potential.

The different elements of the multibreak pole unit located within the enclosure 10, are supported by longitudinally extending beams 30 of insulating material, one beam 30 being shown in FIG. 2 and secured to the bottom cover 24 by bolts 34. A plurality of circular partition plates or discs 36, 38, 40, 42, 44 of conductive material are spaced apart along the beams 30, each plate 36 to 44 being surrounded by an arcing ring 32. The end plates 36, 44 are aligned with the bushings 20, 22 respectively, and electrically connected thereto through plug-in connections. The intermediate plates 38, 40, 42 are regularly spaced apart along the beams 30 so as to define four successive sections 50, 52, 54, 56, each of which corresponds to a breaking interval of the pole, which comprises on the whole four breaking points in the example shown. The distance between the plates 36 to 44 is of course adapted to the required insulation level for pressurized sulfur hexafluoride.

The arc-extinguishing devices which are electrically series-connected and located in the respective sections 50, 52, 54, 56 are of the puffer type. Each device comprises a main stationary contact 58 and a main movable contact 60. The movable contacts 60 of the sections 50 to 56 are actuated by means of a pair of control rods 62, 64 of insulating material. The four breaking devices are arranged in two groups, the devices of odd rank being essentially located in the sections 50, 54 and the elements of even rank extending substantially within the sections 52, 56. The devices of odd rank are aligned on the axis of the first rod 62 which is laterally offset with respect of the axis of the cylindrical enclosure 10, and the devices of even rank are aligned on the axis of the second rod 64 which is also offset with respect to the axis of the cylinder, both rods 62, 64 being symmetrical with respect to the axis of the enclosure 10. The staggering of the arc-extinguishing devices permits an overlapping of adjacent devices and thereby a reduction of the overall length of the pole. The conducting plates 36, 38, 40, 42, 44 ensure the electrical connection between the contacts and the input and output conductors 20, 22, on the one hand, and between the movable 60 and stationary 58 contacts of the successive arc-extinguishing devices, on the other hand. Voltage-dividing capacitors (not shown) may advantageously be inserted between successive plates 36 to 44 in a well-known manner.

The main movable contacts 60 and the puffer mechanisms of sections 50, 54 and 52, 56 are respectively actuated by control rods 62, 64 which are secured to a control rod 66 of a hydraulic operating cylinder device 68 arranged outside the enclosure 10. Such a pole has been described in detail in the U.S. Pat. No. 3,895,202.

A closing resistor and an auxiliary contact device are associated to each section 50 to 56 of the multi-breaker pole unit in order to limit the switching overvoltages upon closing. The arc-extinguishing devices are all identical so that only one of them, associated with the section 56, will now be described in more detail. The closing resistor comprises two series connected resistor elements 70, 72 of cylindrical shape, each element comprising a stock of resistor discs (not shown) inserted between connection terminals arranged on the front faces. The two resistor elements 70, 72 extending parallel to plate 42 are superposed in the axial symmetrical plane of the enclosure 10, shown by line II—II on FIG. 1. The length of the resistor elements 70, 72 is smaller than the diameter of plate 42, and they are shifted inside enclosure 10 to the right of FIG. 2 so as to define on the left a space for the auxiliary contact device comprising stationary and movable auxiliary contacts 74, 76 and their operating mechanism. A connecting strip 78 ensures the electrical connection between the two resistor elements 70, 72, the opposite terminal of the lower element 70 being connected to the conductive plate 42, and the opposite terminal of the upper element 72 being connected to a plug of the movable auxiliary contact 76. The stationary auxiliary contact 74 is secured to plate 44, and it is easy to see that in the closed position of auxiliary contacts 74, 76 the series connected resistor elements 70, 72 are electrically connected to plates 42, 44, in parallel with the main circuit including the main stationary and movable contacts 58, 60. The distance betweenplates 42, 44 is subdivided into three superposed spaces, comprising a first space near plate 42 which includes the lower resistor element 70, an intermediate second space for the upper resistor element 72 and a third space near plate 44 which includes the breaking intervals of the auxiliary contacts 74, 76 and of the main contacts 58, 60. A gas blast exhaust deflector 80 (FIG. 1) carried by the upper face of plate 42, is associated in section 56 to the stationary main contact 58 of the arc-extinguishing device of section 54. The resistor elements 70, 72 are inserted in section 56 between the deflector 80 and the associated portion of the movable main contact 60.

All the auxiliary contacts 74, 76 of sections 50, 52, 54, 56 are aligned vertically and are mechanically actuated by an auxiliary control rod 82 which is directly connected to the movable auxiliary contacts 76. The first and second main control rods 62, 64 are moved by the hydraulic operating cylinder device 68 via control rod 66, such as described in the quoted U.S. Pat. No. 3,895,202. The auxiliary control rod 82 traverses the bottom cover 24 and is mechanically connected to an auxiliary operating mechanism 84 located within a cabinet 86 of enclosure 10. The auxiliary mechanism 84 may be a linkage connected at point 88 to the piston rod 66 so as to constitute a follower device which couples for movement the movable auxiliary contacts 76 with the movable main contacts 60. An example of a follower device is described in the French Pat. No. 2,309,028, but any other mechanical or hydraulic operating linkage may be used to effect a closing or opening movement of the movable auxiliary contacts 76.

Cabinet 86 communicates with enclosure 10, and the connection point 88 is located within said enclosure so as to avoid any additional gas-tight dynamic bushing.

During the opening of the above described circuit breaker, the closing of auxiliary contacts 74, 76 connects the closing resistor into the circuit during a switching-in operation prior to engagement of the main contacts 58, 60. The resistor elements 70, 72 are then disconnected at the opening of the auxiliary contacts 74, 76 after the main contacts 58, 60 have engaged.

The arrangement of the resistor elements 70, 72 and the auxiliary contacts 74, 76 within enclosure 10 is adapted to the insulation level and maintains the space of usual pole units without closing resistors. The adjunction of these resistors may be effected after assembling of the circuit breaker.

What we claim is:

1. A multibreaker arc-extinguishing pole unit for a high-voltage metal-clad puffer type circuit breaker, comprising:

a grounded metal enclosure of substantially cylindrical shape adapted to contain a compressed arc-extinguishing gas of high dielectric strength;

a plurality of electrically series-connected arc-extinguishing units spaced apart in said enclosure in the longitudinal direction thereof, each unit having a pair of elongated separable main contact means extending parallel to said longitudinal direction to draw an arc therebetween, and a puffer mechanism coaxial with said main contact means and adapted to draw gas from the inside of said enclosure to direct a blast of compressed gas on said arc, said main contact means comprising a relatively stationary contact and a movable contact;

support beam means extending in said longitudinal direction within said enclosure;

a plurality of transverse partition plates extending perpendicularly to said longitudinal direction and secured to said support beam means at regular intervals to define a number of sections therebetween corresponding to the number of arc-extinguishing units;

main control rod means extending in said enclosure parallel to said longitudinal direction to actuate said movable contact;

said main contact means and said puffer mechanisms of the arc-extinguishing units being arranged in staggered fashion such that units of odd rank are aligned along a first axis and said main contact means and said puffer mechanisms of the arc-extinguishing units of even rank are aligned along a second axis, said axes extending parallel to said longitudinal direction symmetrically with respect to the axis of said cylindrical enclosure;

said transverse plates supporting said units in such a manner that in all sections but the first the corresponding arc-extinguishing unit is juxtaposed to the unit of next-higher rank so that said units overlap each other laterally thereby reducing the overall length of the assembled units of the pole;

a series-connected resistor and auxiliary interrupter means inserted in each of said sections between two successive partition plates, each resistor comprising two series connected elongated resistor elements extending crosswise to said longitudinal direction and being superposed in said longitudinal direction, the auxiliary interrupter means being all coaxial, and an auxiliary control rod for actuating all of said auxiliary interrupter means, said auxiliary control rod extending in said longitudinal direction within said enclosure.

2. A multibreak arc-extinguishing pole unit according to claim 1, wherein said vent opening means comprises a deflector which expels the arc-extinguishing gases in the opposite direction of said resistors.

3. A circuit interrupter according to claim 1, having an operating linkage connecting mechanically said auxiliary and main control rods so as to insert the resistors during a closing operation of the pole prior to the closing of the pole unit.

4. A multibreak arc-extinguishing pole unit according to claim 3, wherein said operating linkage connecting mechanically said auxiliary and main control rods is located within a cabinet which communicates with said enclosure.

5. A circuit interrupter according to claim 1, wherein said auxiliary interrupter means are arranged in each section substantially at the same level along said longitudinal direction as said main contact means.

6. The device of claim 1 wherein said puffer mechanism comprises a piston, means forming a cylinder arranged at one end of the corresponding arc-extinguishing unit adjacent said movable contact, and vent opening means for exhausting said blast of compressed gas into said enclosure positioned at the opposite end of said arc-extinguishing unit adjacent said relatively stationary contact, said pistion and said cylinder means being movable relative to one another so as to generate said blast of compressed gas.

7. A pole unit as claimed in claim 1, wherein for each of said sections between two successive partition plates, said auxiliary interrupter means is substantially horizontally adjacent to said resistor.

* * * * *